US009102146B2

(12) United States Patent
Yamato et al.

(10) Patent No.: US 9,102,146 B2
(45) Date of Patent: Aug. 11, 2015

(54) PRINTHEAD SUBSTRATE, PRINTHEAD, AND PRINTING APPARATUS

(71) Applicant: CANON KABUSHIKI KAISHA, Tokyo (JP)

(72) Inventors: Hidenori Yamato, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/914,918

(22) Filed: Jun. 11, 2013

(65) Prior Publication Data

US 2013/0342609 A1 Dec. 26, 2013

(30) Foreign Application Priority Data

Jun. 20, 2012 (JP) ..... 2012-139157

(51) Int. Cl.

| | |
|---|---|
| ***B41J 2/04*** | (2006.01) |
| ***B41J 29/38*** | (2006.01) |
| ***B41J 2/05*** | (2006.01) |
| ***B41J 2/14*** | (2006.01) |
| *B41J 2/045* | (2006.01) |

(52) U.S. Cl.

CPC *B41J 2/14* (2013.01); *B41J 2/0458* (2013.01); *B41J 2/04541* (2013.01); *B41J 2/04555* (2013.01); *B41J 2/04588* (2013.01)

(58) Field of Classification Search

CPC ..... B41J 2/04581; B41J 2/04588; B41J 2/04541; B41J 2/04593; B41J 2/0458; B41J 2/04596; B41J 2/04543; B41J 2/04563; B41J 2/04573

See application file for complete search history.

(56) References Cited

U.S. PATENT DOCUMENTS

| | | | | |
|---|---|---|---|---|
| 5,956,242 | A * | 9/1999 | Majid et al. | 363/21.16 |
| 7,597,424 | B2 | 10/2009 | Hirayama | |
| 7,850,262 | B2 | 12/2010 | Hirayama et al. | |
| 2007/0211095 | A1 | 9/2007 | Hirayama | |

FOREIGN PATENT DOCUMENTS

| | | |
|---|---|---|
| JP | 2006-7763 A | 1/2006 |

* cited by examiner

*Primary Examiner* — Lisa M Solomon

(74) *Attorney, Agent, or Firm* — Fitzpatrick, Cella, Harper & Scinto

(57) ABSTRACT

A printhead substrate, comprising a plurality of printing elements which are assigned to a plurality of groups, a plurality of driving circuits which are arranged in correspondence with the respective groups and drive the printing elements, a first current source configured to generate currents of a plurality of current amounts corresponding to the respective groups, second current sources which are arranged in correspondence with the respective driving circuits and configured to generate currents to be supplied to the printing elements, and setting units configured to generate voltages in accordance with currents generated by the first current source and set currents to be generated by the second current sources based on the voltages.

8 Claims, 9 Drawing Sheets

PRINTHEAD SUBSTRATE, PRINTHEAD, AND PRINTING APPARATUS

BACKGROUND OF THE INVENTION

1. Field of the Invention

The present invention relates to a printhead substrate, printhead, and printing apparatus.

2. Description of the Related Art

A printhead substrate can employ a time-divisional driving method of dividing a plurality of printing elements into a plurality of blocks and driving the printing elements for the respective blocks in order to suppress the influence of heat between adjacent printing elements. A plurality of printing elements arranged on a printhead substrate are assigned to respective groups by a predetermined number of adjacent printing elements. The "block" represents printing elements of the respective groups for which driving control is performed at the same timing.

Japanese Patent Laid-Open No. 2006-7763 discloses a structure in which a reference current circuit forming a current mirror with a current source disposed for each group is arranged. Each current source supplies, to each printing element to be driven in each group, a current corresponding to the current value of the reference current circuit in accordance with an externally input signal. The externally input signal is determined based on manufacturing variations between printhead substrates. In Japanese Patent Laid-Open No. 2006-7763, this arrangement controls the driving forces of a plurality of printing elements in accordance with manufacturing variations between printhead substrates.

If the characteristics of printing elements greatly vary on a single printhead substrate, the driving forces of the printing elements need to be controlled individually. The technique disclosed in Japanese Patent Laid-Open No. 2006-7763 is advantageous for manufacturing variations between printhead substrates, but does not consider characteristic variations between printing elements on a single printhead substrate.

SUMMARY OF THE INVENTION

The present invention provides a technique advantageous for printing in correspondence with characteristic variations between printing elements on a single printhead substrate.

One of the aspects of the present invention provides a printhead substrate, comprising a plurality of printing elements which are assigned to a plurality of groups, a plurality of driving circuits which are arranged in correspondence with the respective groups and drive the printing elements, a first current source configured to generate currents of a plurality of current amounts corresponding to the respective groups, second current sources which are arranged in correspondence with the respective driving circuits and configured to generate currents to be supplied to the printing elements, and setting units configured to generate voltages in accordance with currents generated by the first current source and set currents to be generated by the second current sources based on the voltages.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings. In the following description, a printing apparatus using an inkjet printing method will be exemplified. The printing apparatus may be, for example, a single-function printer having only the printing function, or a multi-function printer having a plurality of functions such as the printing function, FAX function, and scanner function. The printing apparatus may be a manufacturing apparatus for manufacturing a color filter, electronic device, optical device, microstructure, or the like by a predetermined printing method.

In the following description, "print" not only includes the formation of significant information such as characters and graphics, but also broadly includes the formation of images, designs, patterns, structures, and the like on a printing medium, or processing of the medium, regardless of whether they are significant or insignificant and whether they are so visualized as to be visually perceived by humans.

Also, a "printing medium" not only includes paper used in general printing apparatuses, but also includes materials capable of accepting ink, such as cloth, plastic film, metal plate, glass, ceramics, resin, wood, and leather.

Also, "ink" should be broadly interpreted, similar to the definition of "print" described above. "Ink" includes a liquid which, when applied onto a printing medium, can form images, designs, patterns, and the like, can process the printing medium, or can be used for ink processing (for example, solidification or insolubilization of a coloring material contained in ink to be applied to a printing medium).

Figure 1:
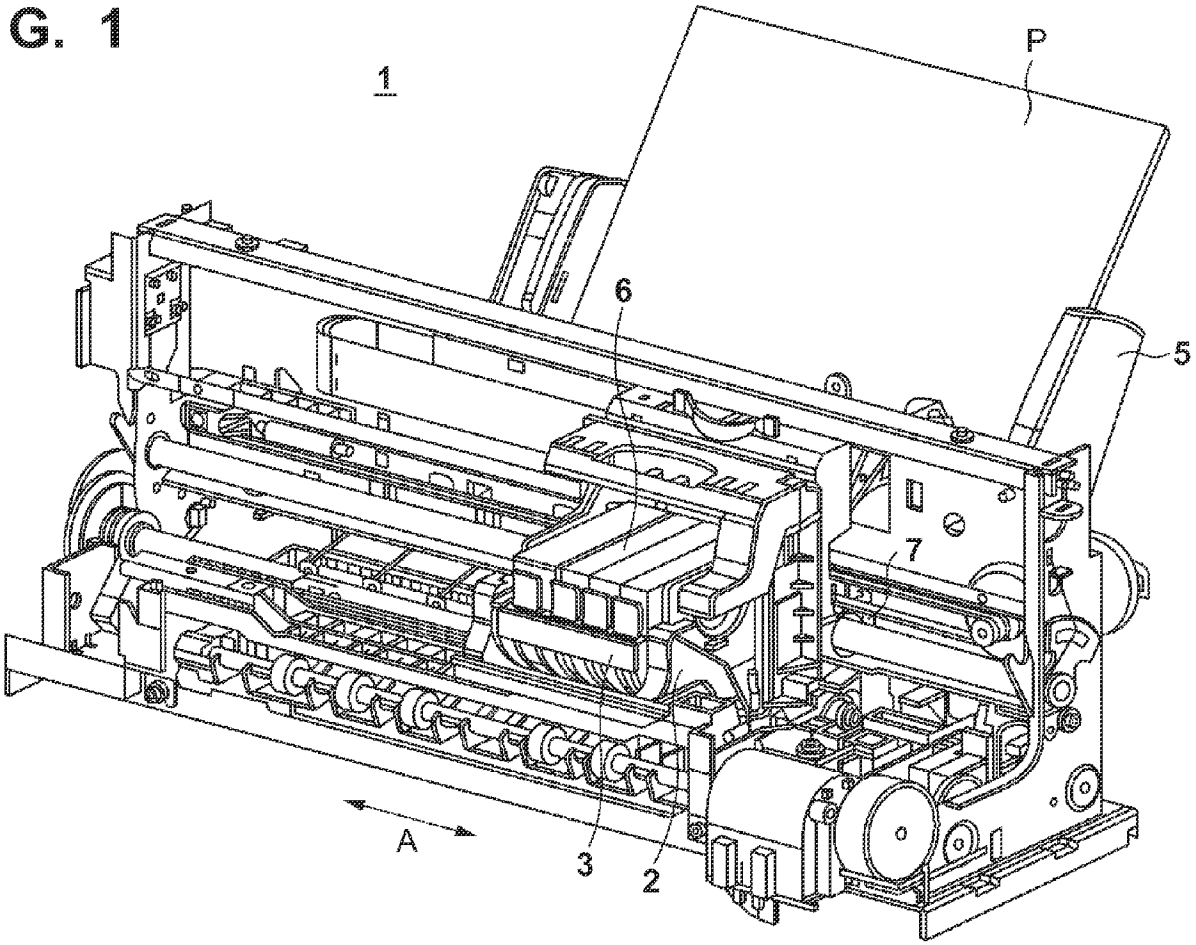
FIG. 1 is a perspective view exemplifying the outer appearance of an inkjet printing apparatus 1 according to an embodiment of the present invention.

FIG. 1 is a perspective view exemplifying the outer appearance of an inkjet printing apparatus 1 according to an embodiment of the present invention. In the inkjet printing apparatus (to be referred to as a printing apparatus hereinafter) 1, an inkjet printhead (to be referred to as a printhead hereinafter) 3 for discharging ink according to an inkjet method to print is mounted on a carriage 2. The carriage 2 reciprocates in directions indicated by an arrow A to print. The printing apparatus 1 feeds a printing medium P such as printing paper via a sheet supply mechanism 5, and conveys it to a printing position. At the printing position, the printhead 3 discharges ink onto the printing medium P, thereby printing.

In addition to the printhead 3, for example, ink cartridges 6 are mounted on the carriage 2 of the printing apparatus 1. Each ink cartridge 6 stores ink to be supplied to the printhead 3. The ink cartridge 6 is detachable from the carriage 2.

The printing apparatus 1 shown in FIG. 1 is capable of color printing. For this purpose, four ink cartridges which contain magenta (M), cyan (C), yellow (Y), and black (K) inks are mounted on the carriage 2. These four ink cartridges are independently detachable.

The printhead 3 according to the embodiment adopts, for example, an inkjet method of discharging ink using thermal energy. The printhead 3 includes electrothermal transducers. The electrothermal transducers are arranged in correspondence with respective orifices. A pulse voltage is applied to an electrothermal transducer corresponding to a printing signal, thereby discharging ink from a corresponding orifice. In the embodiment, discharge of ink using a heater will be explained as an ink discharge method, but the present invention is not limited to this. The present invention may employ various inkjet methods such as a method using a piezoelectric element, a method using an electrostatic element, and a method using a MEMS element.

Figure 2:
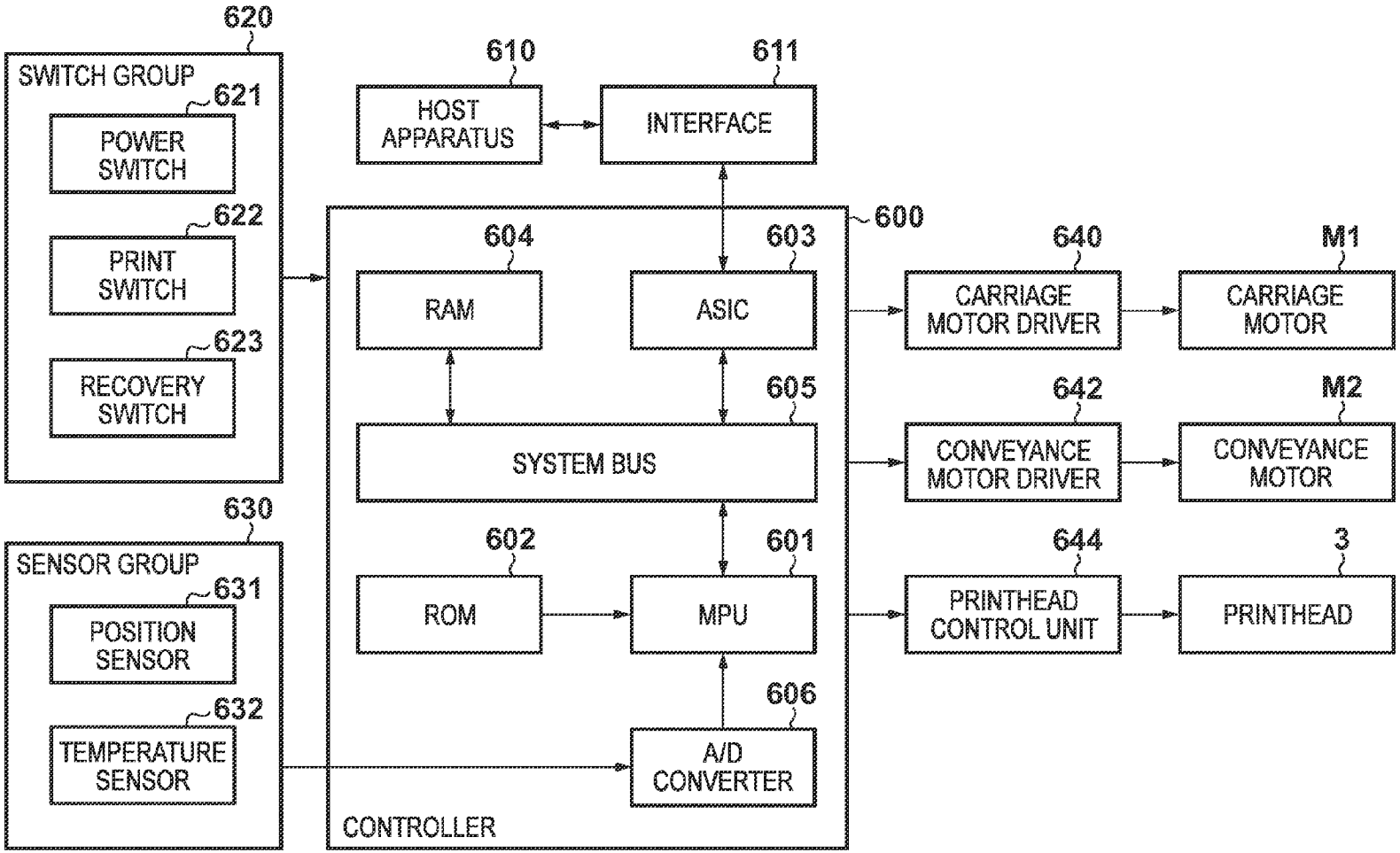
FIG. 2 is a block diagram exemplifying the functional arrangement of the printing apparatus 1 shown in FIG. 1.

FIG. 2 is a block diagram exemplifying the functional arrangement of the printing apparatus 1 shown in FIG. 1.

A controller 600 includes an MPU 601, ROM 602, application specific integrated circuit (ASIC) 603, RAM 604, system bus 605, and A/D converter 606.

The ROM 602 stores programs corresponding to control sequences (to be described later), necessary tables, and other permanent data. The ASIC 603 controls a carriage motor M1 and conveyance motor M2. Also, the ASIC 603 generates a control signal for controlling the printhead 3. The RAM 604 is used as an image data rasterization area, a work area for executing a program, and the like. The RAM 604 stores control information (current information) and time-divisional information to be described later. The system bus 605 connects the MPU 601, ASIC 603, and RAM 604 to each other to exchange data. The A/D converter 606 A/D-converts an analog signal input from a sensor group (to be described later), and supplies the converted digital signal to the MPU 601.

A switch group 620 includes a power switch 621, print switch 622, and recovery switch 623. A sensor group 630 is used to detect an apparatus state, and includes a position sensor 631 and temperature sensor 632. When scanning the printhead 3, the ASIC 603 transfers, to the printhead 3, data for driving printing elements while directly accessing the storage area of the RAM 604.

The carriage motor M1 is a driving source for reciprocally scanning the carriage 2 in directions indicated by the arrow A. A carriage motor driver 640 controls driving of the carriage motor M1. The conveyance motor M2 is a driving source for conveying the printing medium P. A conveyance motor driver 642 controls driving of the conveyance motor M2.

The printhead 3 is scanned in a direction (to be referred to as a scanning direction hereinafter) perpendicular to the conveyance direction of the printing medium P. More specifically, the printhead 3 is scanned relatively to the printing medium.

A computer (or a reader for reading an image, a digital camera, or the like) 610 serves as an image data supply source, and is generically called a host apparatus or the like. The host apparatus 610 and printing apparatus 1 exchange image data, commands, status signals, and the like via an interface (to be referred to as an I/F hereinafter) 611.

First Embodiment

Figure 3:
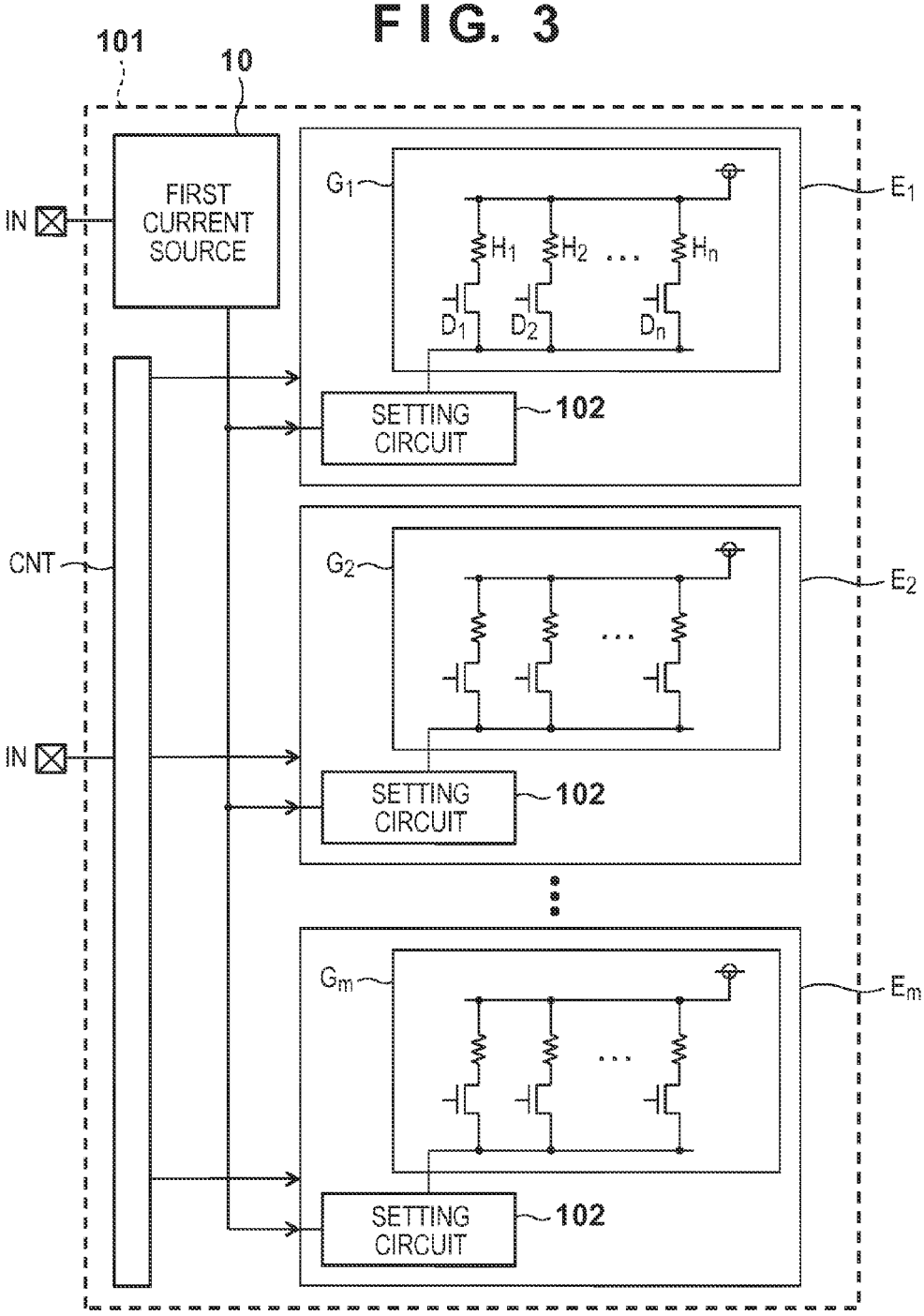
FIG. 3 is a conceptual view for explaining an example of the arrangement of a printhead substrate according to the first embodiment.

A printhead substrate 101 (to be simply referred to as a "substrate 101" hereinafter) according to the first embodiment will be explained with reference to FIGS. 3 to 5. FIG. 3 is a circuit block diagram showing the substrate 101. The substrate 101 includes a plurality of printing elements H (heaters), a plurality of setting units 102, a first current source 10 which supplies a current to the respective setting units 102, and a control unit CNT. Data and signals to be described later are input to an input terminal IN. The setting units 102 are arranged in correspondence with respective groups G, that is, $G_1$ to $G_m$ each assigned to a predetermined number (n in this case) of adjacent printing elements H. The printing elements H (m×n printing elements H in this case) form a printing element array on the substrate 101.

In each group G, driving elements D, that is, $D_1$ to $D_n$ are arranged to drive the printing elements H, that is, $H_1$ to $H_n$. The driving element D is, for example, a MOS transistor. The substrate 101 includes a driving circuit having the driving elements D. A plurality of (m) driving circuits are arranged in correspondence with the respective groups G. When the driving element D is activated (changes to the conductive state), a current flows through the printing element H, and the printing element H generates heat. As described in Description of the Related Art, the substrate 101 employs a time-divisional driving method of driving a plurality of printing elements for respective blocks (n blocks in this case) in order to suppress the influence of heat between the adjacent printing elements H. As will be described later, the control unit CNT controls the printing elements H and setting units 102 to control the overall operation of the substrate 101.

Figure 4:
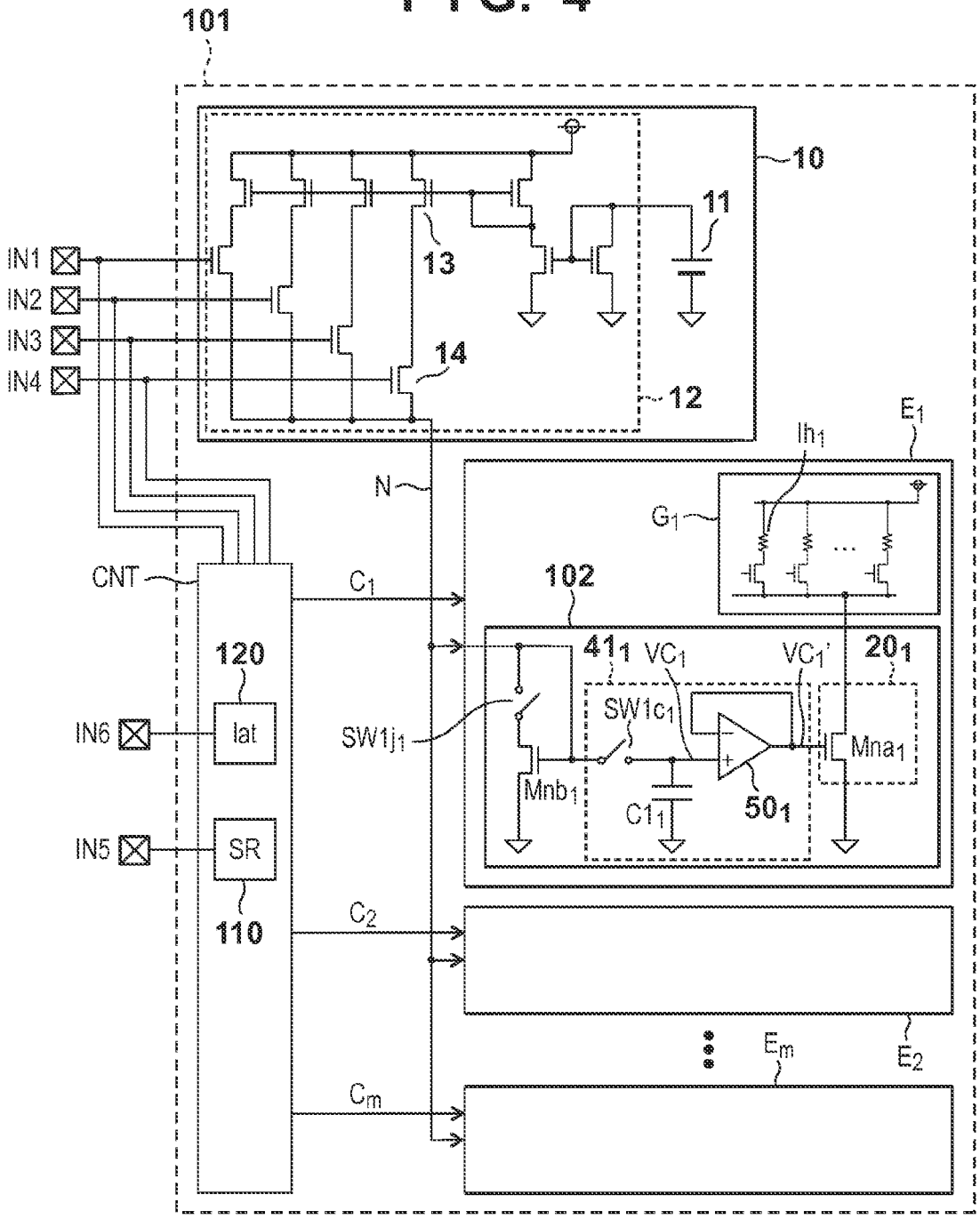
FIG. 4 is a circuit diagram for explaining an example of the arrangement of the printhead substrate according to the first embodiment.
Figure 5:
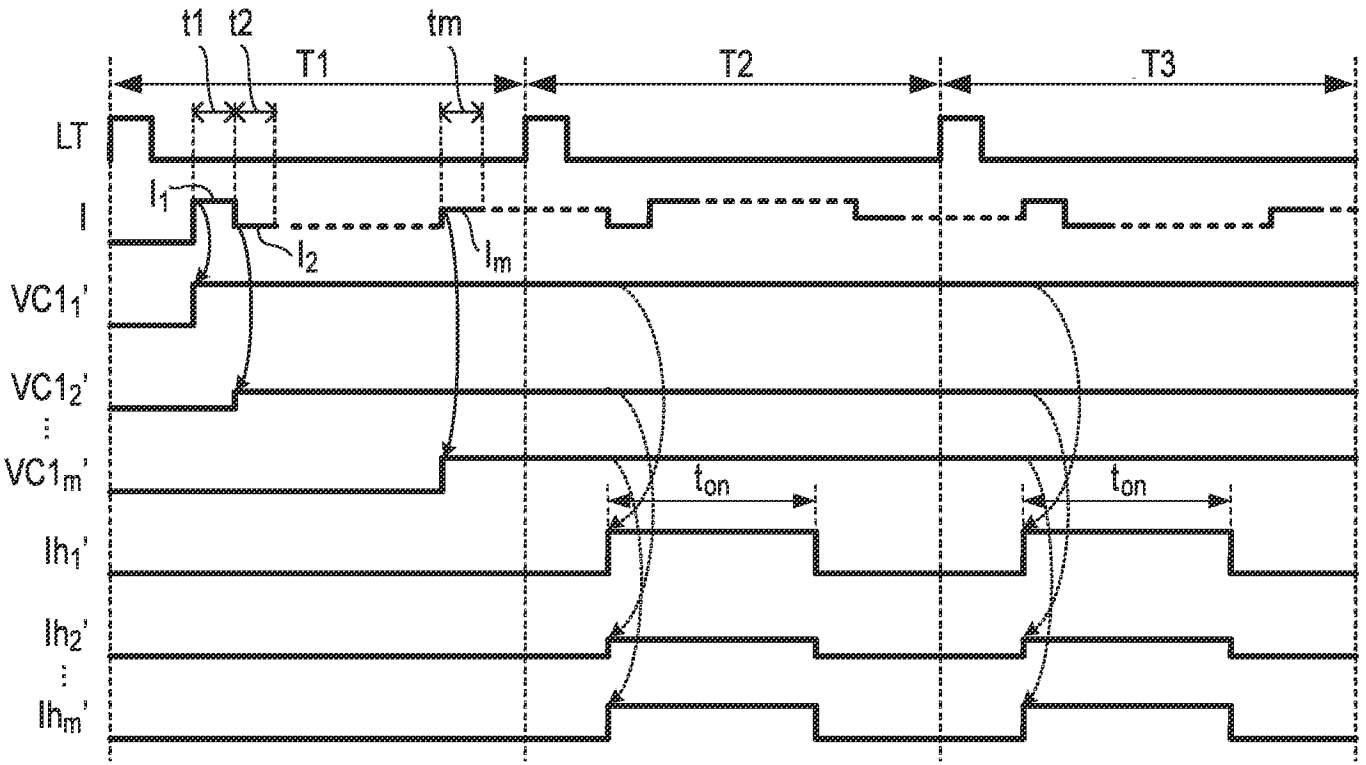
FIG. 5 is a timing chart for explaining an example of a printhead substrate operation method according to the first embodiment.

As shown in FIG. 4, the control unit CNT includes a shift register 110 and latch circuit 120. Data transferred from a controller 600 in FIG. 2 is input to the shift register 110 via an input terminal IN5. The data contains print data, and time-divisional information for selecting a block to be driven in order to time-divisionally drive the n blocks. When a latch signal LT is input to an input terminal IN6, the latch circuit 120 latches the data which has been input to the shift register 110.

In this specification, the groups G, that is, $G_1$ to $G_m$ and the setting units 102 which correspond to each other will be called modules E, that is, $E_1$ to $E_m$.

The first current source 10 supplies a current of an amount complying with external control information to each setting unit 102. The first current source 10 includes a current mirror circuit 12 which receives a voltage generated by a reference voltage source 11. The current mirror 12 includes PMOS transistors 13 and NMOS transistors 14. The numbers of PMOSs 13 and NMOSs 14 to be turned on are determined in accordance with control information (current information), and the amount of a current I flowing through a node N is determined. When the value of control information changes, the numbers of PMOSs 13 and NMOSs 14 to be turned on also change, and the amount of the current I flowing through the node N also changes.

The control information is determined based on characteristic variations between the printing elements H. More specifically, the control information is determined based on, for example, characteristics obtained by measurement before shipment of the substrate 101. The control information may be stored in the storage unit (for example, a RAM 604 in FIG. 2) of a printing apparatus 1, and output from the storage unit to the substrate 101 by a known output unit of the printing apparatus 1 when printing by the printing apparatus 1. The control information may be stored in the storage unit by reading the control information of the mounted substrate 101 from the serial number by the printing apparatus 1, or by collecting it by the printing apparatus 1 via a predetermined network. The stored control information may be periodically updated by appropriately checking the characteristics of the substrate 101 by the printing apparatus 1 in accordance with the temperature, air pressure, use period, replacement of the printhead, or the like while, for example, the printing apparatus 1 operates.

FIG. 4 exemplifies the detailed arrangement of the substrate 101. In FIG. 4, the modules $E_2$ to $E_m$ have the same arrangement as that of the module $E_1$, and their internal arrangements are not illustrated for simplicity. The setting units 102 include second current sources 20, that is, $\mathbf{20}_1$ to $\mathbf{20}_m$, and first voltage holding units 41, that is, $\mathbf{41}_1$ to $\mathbf{41}_m$, respectively. In other words, the first voltage holding unit 41 is a sample-and-hold circuit. FIG. 4 illustrates the second current source $\mathbf{20}_1$ and first voltage holding unit $\mathbf{41}_1$, and does not illustrate the second current sources $\mathbf{20}_2$ to $\mathbf{20}_m$ and first voltage holding units $\mathbf{41}_2$ to $\mathbf{41}_m$. This also applies to the remaining reference symbols.

The second current sources 20 are formed from, for example, MOS transistors Mna, that is, $Mna_1$ to $Mna_m$, respectively, and are current sources for driving a predetermined number of printing elements H belonging to the corresponding group G by a constant current driving method. The first voltage holding units 41 include capacitors C1, that is, $C\mathbf{1}_1$ to $C\mathbf{1}_m$ for holding a voltage to maintain the current amount of the second current source 20, differential amplifiers 50, that is, $\mathbf{50}_1$ to $\mathbf{50}_m$, and switches SW1*c*, that is, $SW\mathbf{1}c_1$ to $SW\mathbf{1}c_m$ for connecting the first current source 10 to the capacitor C1. The capacitor C1 can use a known capacitive element, including a MOS capacitor. The switch SW1*c* can use a known switching element, including a MOS transistor and analog switch.

The differential amplifier 50 amplifies a voltage $VC_1$ of the capacitor C1, and outputs the amplified voltage $VC_1'$. The setting units 102 further include MOS transistors Mnb, that is, $Mnb_1$ to $Mnb_m$ for supplying the current of the first current source 10, and switches SWj, that is, $SWj_1$ to $SWj_m$ for connecting the first current source 10 and the MOS transistor Mnb. The switch SWj can use a known switching element, including a MOS transistor and analog switch.

In other words, in the above arrangement, the MOS transistor Mna serving as the second current source 20, and the MOS transistor Mnb form a current mirror circuit, and the current mirror circuit is connected to the sample-and-hold circuit. The current mirror circuit is connected between the gates of the MOS transistors Mna and Mnb. The gates of the MOS transistors Mna and Mnb are control electrodes.

The control unit CNT switches the switches SWj and SW1*c* in accordance with a control signal $C_1$ in the following manner. Based on the control signal $C_1$, the setting circuit 102 samples and holds a voltage generated inside the current mirror circuit by the first voltage holding unit 41 (sample-and-hold circuit). First, the switch SWj changes to the conductive state, and a current from the first current source 10 flows through the MOS transistor Mnb. Further, the switch SW1*c* changes to the conductive state, and the MOS transistor Mna (second current source 20) transmits a current of an amount corresponding to the current amount of the first current source 10. As a result, the second current source 20 forms a current mirror with the first current source 10. The differential amplifier 50 amplifies the voltage $VC_1$ of the capacitor C1, and outputs the amplified voltage $VC_1'$ to the gate of the MOS transistor Mna. This arrangement can suppress the influence of potential fluctuations generated in the MOS transistor Mna on the voltage of the capacitor C1 upon printing.

The control unit CNT performs the first and second operations in the following manner. In the first operation, the control unit CNT individually controls each setting unit 102 so that the setting unit 102 holds, in the corresponding first voltage holding unit 41, a voltage corresponding to the current amount of the first current source 10. More specifically, the switch SW1*c* changes to the conductive state to charge the capacitor C1 so that the second current source 20 can maintain a current of an amount corresponding to the current amount of the first current source 10. Then, the switch SW1*c* changes to the non-conductive state to hold the voltage of the capacitor C1.

In the second operation, the driving element D corresponding to the printing element H to be driven is activated (changes to the conductive state). Accordingly, the second current source 20 can supply, to the printing element H to be driven, a current Ih corresponding to the voltage held by the first voltage holding unit 41.

In this way, the control unit CNT can switch the driving element D in each module E, and supply a current to the printing element H in accordance with a voltage level held by the capacitor C1. This operation will be described in more detail.

As shown in FIG. 4, the input terminals IN1 to IN4 receive, for example, a 4-bit digital signal as control information (current information). At this time, the respective bits of the digital signal are input to respective input terminals IN100. In response to this, the first current source 10 supplies, to each setting unit 102, a current of an amount corresponding to the digital signal. In the embodiment, the first current source 10 functions as a digital-to-analog converter which converts current control information (digital signal) into a current (analog signal) of an amount corresponding to it. For example, a current of an amount corresponding to control information (current information) among current amounts for 16 tones (corresponding to 4 bits) is obtained for each group. The control information is input in a predetermined group order. In the embodiment, the control information is input in the order of group 1, group 2, . . . , group m. The control unit CNT controls the setting unit 102 in correspondence with the control information input order.

A series of operations in the first and second operations will be explained with reference to FIG. 5. FIG. 5 is a timing chart for operating the substrate 101. In FIG. 5, the ordinate represents from the top the latch signal LT, the current I of the node N corresponding to the current amount of the first current source 10, and the output voltage VC' of the differential amplifier 50. In the first cycle T1, the first current source 10 receives control information corresponding to the group. In periods $t_1, t_2, \ldots, t_m$, the first current source 10 generates $I_1, I_2, \ldots, I_m$. The latch signal LT is a signal for initializing print data stored in the shift register 110 after driving of one block in order to perform time-divisional driving. The shift register 110 receives, for example, a clock signal (not shown). Current amounts Ih, that is, $Ih_1$ to $Ih_m$ flowing through the printing elements H to be driven in the respective groups G are represented below the output voltage VC' of the differential amplifier 50. The abscissa represents the time, and represents, for example, the first cycle T1, second cycle T2, and third cycle T3. These cycles correspond to the driving timings of the printing elements H.

In the first cycle T1, the first operation is performed. More specifically, in the first cycle T1, each first voltage holding unit 41 holds, as the voltage $VC_1$, the current I of the node N corresponding to the current amount of the first current source 10. For example, in the module $E_1$, the setting unit 102 holds the voltage as a voltage $VC\mathbf{1}_1$ in the first voltage holding unit $\mathbf{41}_1$ in accordance with the current amount of the first current source 10. More specifically, control information for the group $G_1$ is input to the substrate 101, and the first current source 10 supplies a current of an amount corresponding to the control information. The switch $SWj_1$ changes to the conductive state, and the current from the first current source 10 flows through the MOS transistor $Mnb_1$. Then, the switch $SW1c_1$ changes to the conductive state, and the capacitor $C1_1$ is charged until the voltage $VC1_1$ of the capacitor $C1_1$ reaches the gate potential of the MOS transistor $Mnb_1$. After the switch $SW1c_1$ changes to the non-conductive state, the switch $SWj_1$ changes to the non-conductive state. As a result, the first voltage holding unit $41_1$ holds the voltage as the potential $VC1_1$, by the current I of the node N corresponding to the current amount (corresponding to control information) of the first current source 10.

In the module $E_2$, the setting unit 102 charges the capacitor $C1_2$ by the current I of the node N corresponding to the current amount of the first current source 10. More specifically, control information for the group $G_2$ is input to the substrate 101 in the above-described fashion. The capacitor $C1_2$ is charged by a current $I_2$ corresponding to the control information (current information). The first voltage holding unit $41_2$ holds the voltage as the potential $VC1_2$. In the same way, in the modules $E_3$ to $E_m$, the setting units 102 hold the voltage as voltages $VC1_3$ to $VC1_m$ in the corresponding first voltage holding units $41_3$ to $41_m$ in accordance with pieces of control information. The control unit CNT performs the first operation of the setting units 102 in the control information input order. The gates of the MOS transistors Mna each operating as the second current source 20 maintain potentials corresponding to the input pieces of control information.

In the second cycle T2, the second operation is performed. More specifically, in the second cycle T2, the second current source 20 in each module E supplies a current corresponding to the voltage of the first voltage holding unit 41 to one printing element H to be driven among a predetermined number of printing elements H belonging to the corresponding group G. One printing element H to be driven among a predetermined number of printing elements H is a printing element H to be driven by time-divisional driving, as described above. More specifically, the control unit CNT activates a driving element D corresponding to the printing element H to be driven in each group G in a period $t_{on}$. For example, in the second cycle T2, the driving element $D_1$ is activated in the period $t_{on}$ in order to drive the printing element $H_1$ of the first block. Similarly, in the third cycle T3, the driving element $D_2$ is activated in the period $t_{on}$ in order to drive the printing element $H_2$ of the second block. The driving elements D are activated sequentially in the respective cycles.

Accordingly, in the period $t_{on}$, currents of amounts corresponding to pieces of control information are supplied from the second current sources 20 to the corresponding printing elements H to be driven. In the third cycle T3, the second operation is performed. Subsequently, the second operation is performed. The cycles shown in FIG. 5 correspond to the driving timings of the printing elements H.

By executing the first and second operations described above, one block is driven by the time-divisional driving method. A block to be time-divisionally driven is selected by, for example, inputting a block selection signal from the control unit CNT to the printhead, and undergoes printing control. The remaining blocks are also driven similarly in order.

Each driven printing element H generates heat of an energy amount corresponding to control information (current information). The heat causes a bubble in the ink supply channel, discharging ink from a corresponding nozzle. Driving of each printing element H is controlled in accordance with characteristic variations between the printing elements H on the single substrate 101. The substrate 101 can uniform ink discharge amounts from the printhead.

According to the first embodiment, printing coping with characteristic variations between printing elements on the single printhead substrate can be performed, and a high-quality image can be printed. The setting unit 102 is smaller in circuit scale than the first current source 10. The substrate 101 includes the setting units 102 in correspondence with the respective groups G, and can be operated by one first current source 10 by controlling the substrate 101 in the above-described manner. The substrate 101 can therefore achieve the above-described effects while suppressing an increase in circuit scale.

Second Embodiment

Figure 6:
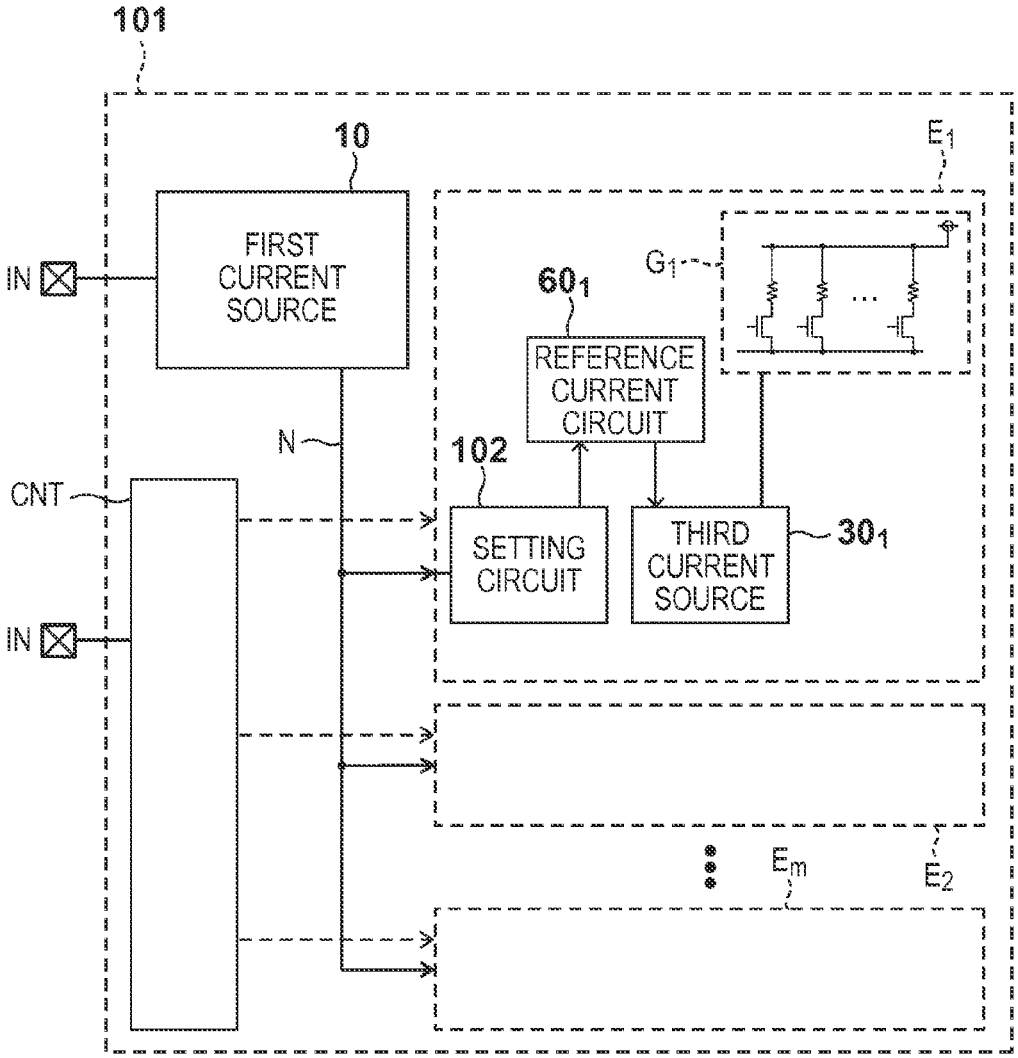
FIG. 6 is a conceptual view for explaining an example of the arrangement of a printhead substrate according to the second embodiment.

A printhead substrate 101 (to be simply referred to as a "substrate 101" hereinafter) according to the second embodiment will be explained with reference to FIGS. 6 and 7. FIG. 6 is a circuit block diagram showing the substrate 101. The second embodiment is greatly different from the first embodiment in that respective modules E further include reference current circuits 60, that is, $60_1$ to $60_m$, and third current sources 30, that is, $30_1$ to $30_m$.

Figure 7:
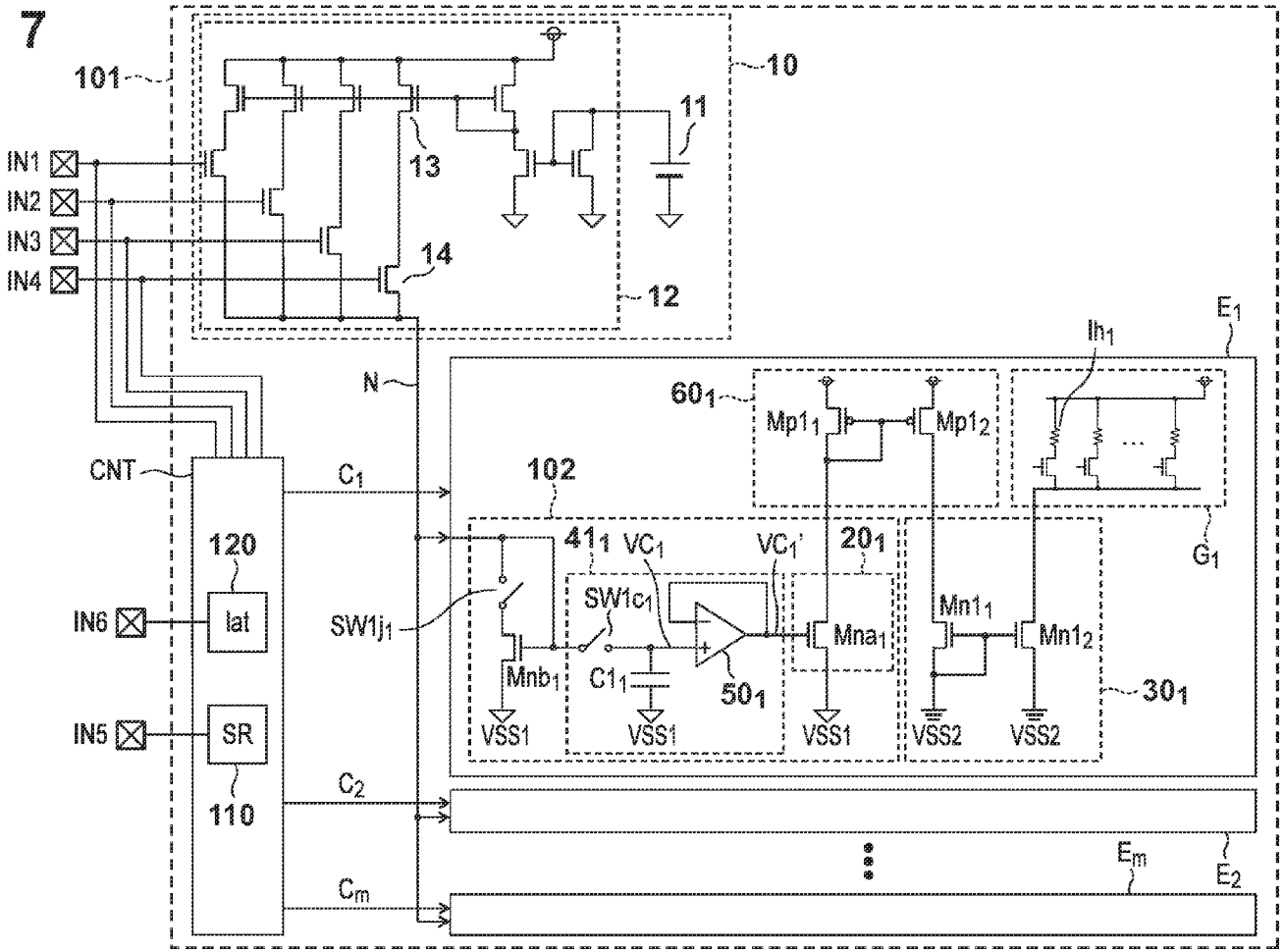
FIG. 7 is a circuit diagram for explaining an example of the arrangement of the printhead substrate according to the second embodiment.

The reference current circuit 60 and third current source 30 are formed from, for example, circuits as shown in FIG. 7. The reference current circuits 60 are configured by, for example, current mirrors formed from PMOS transistors Mp1, that is, $Mp1_1$ to $Mp1_m$, and PMOS transistors Mp2, that is, $Mp2_1$ to $Mp2_m$. The PMOS transistor Mp1 is series-connected to a second current source 20, and transmits a current of the same amount as the amount of a current flowing through the second current source 20. Accordingly, a current of an amount corresponding to the current amount of the PMOS transistor Mp1 flows through the PMOS transistor Mp2.

The third current sources 30 are configured by, for example, current mirrors formed from NMOS transistors Mn1, that is, $Mn1_1$ to $Mn1_m$, and NMOS transistors Mn2, that is, $Mn2_1$ to $Mn2_m$. The NMOS transistor Mn1 is series-connected to the PMOS transistor Mp2, and transmits a current of the same amount as the amount of a current flowing through the PMOS transistor Mp2. Then, a current of an amount corresponding to the current amount of the NMOS transistor Mn1 flows through the NMOS transistor Mn2. As a result, the third current source 30 forms a current mirror with the second current source 20.

The ground potential in the second current source 20 and that in the third current source 30 are separated into voltages VSS1 and VSS2. A MOS transistor Mna operating as the second current source 20 and a MOS transistor Mnb form a current mirror and share the source (voltage VSS1). The NMOS transistors Mn1 and Mn2 form a current mirror and share the source (voltage VSS2). Even if a plurality of printing elements H are driven, a large current flows, and the potential VSS2 fluctuates, the influence of the substrate bias effect of the MOS transistor Mna can be suppressed. Thus, the MOS transistor Mna can supply a current of an amount corresponding to control information (current information) at high accuracy. The third current source 30 can supply a current of an amount corresponding to control information to the printing element H of the corresponding group G at high accuracy.

The second embodiment can obtain the effects described in the first embodiment at higher accuracy. According to the second embodiment, printing coping with characteristic variations between printing elements on the single printhead substrate can be performed, and a higher-quality image can be printed.

Third Embodiment

Figure 8:
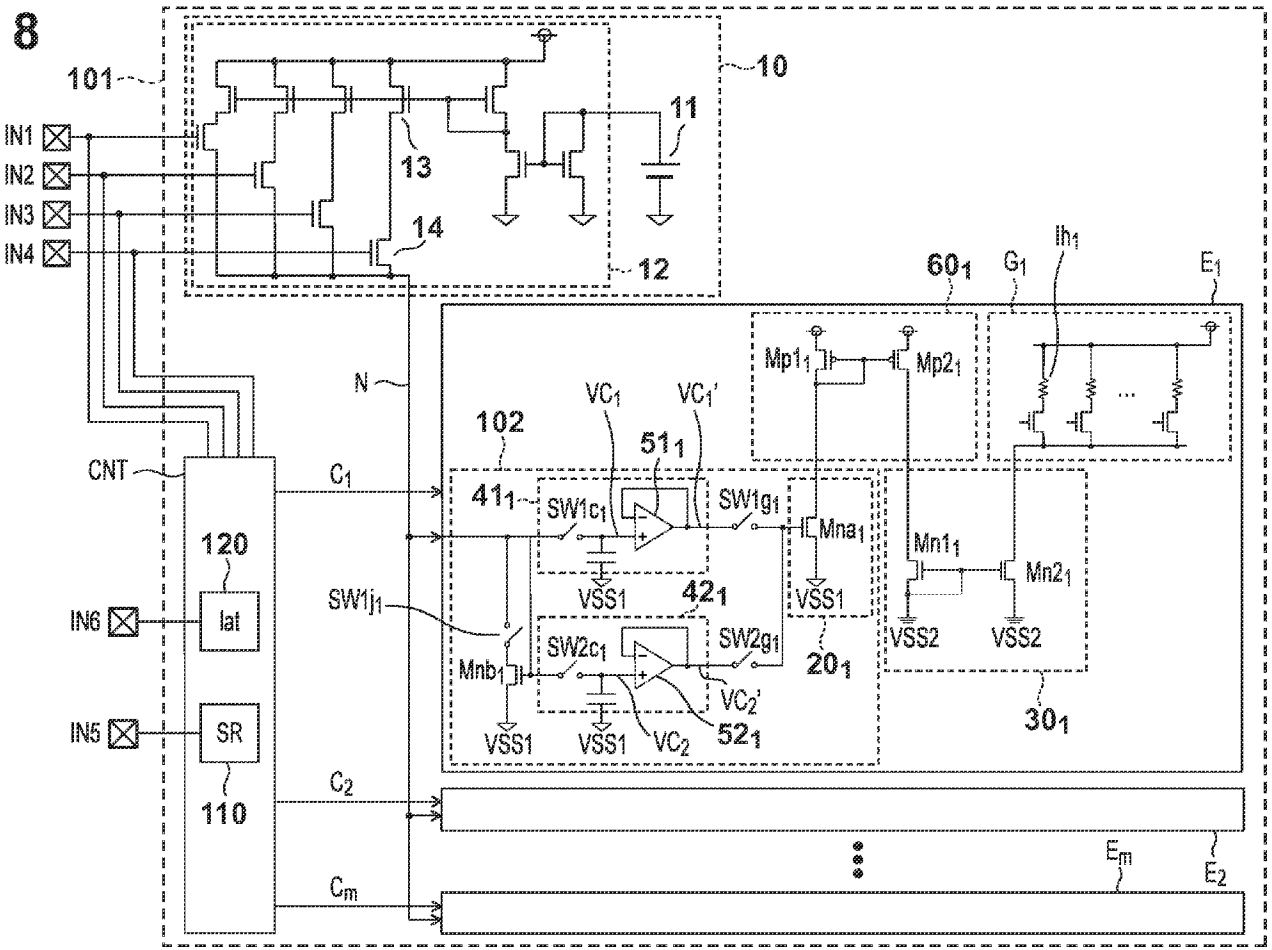
FIG. 8 is a circuit diagram for explaining an example of the arrangement of a printhead substrate according to the third embodiment.

A printhead substrate 101 (to be simply referred to as a "substrate 101" hereinafter) according to the third embodiment will be explained with reference to FIGS. 8 and 9. FIG. 8 exemplifies the circuit arrangement of the substrate 101. The third embodiment is greatly different from the second embodiment in that each setting unit 102 further includes a second voltage holding unit 42. The second voltage holding unit 42 has the same arrangement as that of a first voltage holding unit 41. In each setting unit 102, the first voltage holding unit 41 and second voltage holding unit 42 are connected between MOS transistors Mna and Mnb. The first voltage holding units 41, that is, $\mathbf{41}_1$ to $\mathbf{41}_m$ and the second voltage holding units 42, that is, $\mathbf{42}_1$ to $\mathbf{42}_m$ are juxtaposed with each other. In the third embodiment, switches Sw1$g$, that is, SW1$g_1$ to SW1$g_m$ are connected between the gates of the MOS transistors Mna each operating as a second current source 20, and the first voltage holding units 41. Similarly, switches SW2$g$, that is, SW2$g_1$ to SW2$g_m$ are connected between the gates of the MOS transistors Mna and the second voltage holding units 42. Each setting circuit 102 selects the first voltage holding unit 41 and second voltage holding unit 42 based on a control signal $C_1$, and performs sampling and holding.

Figure 9:
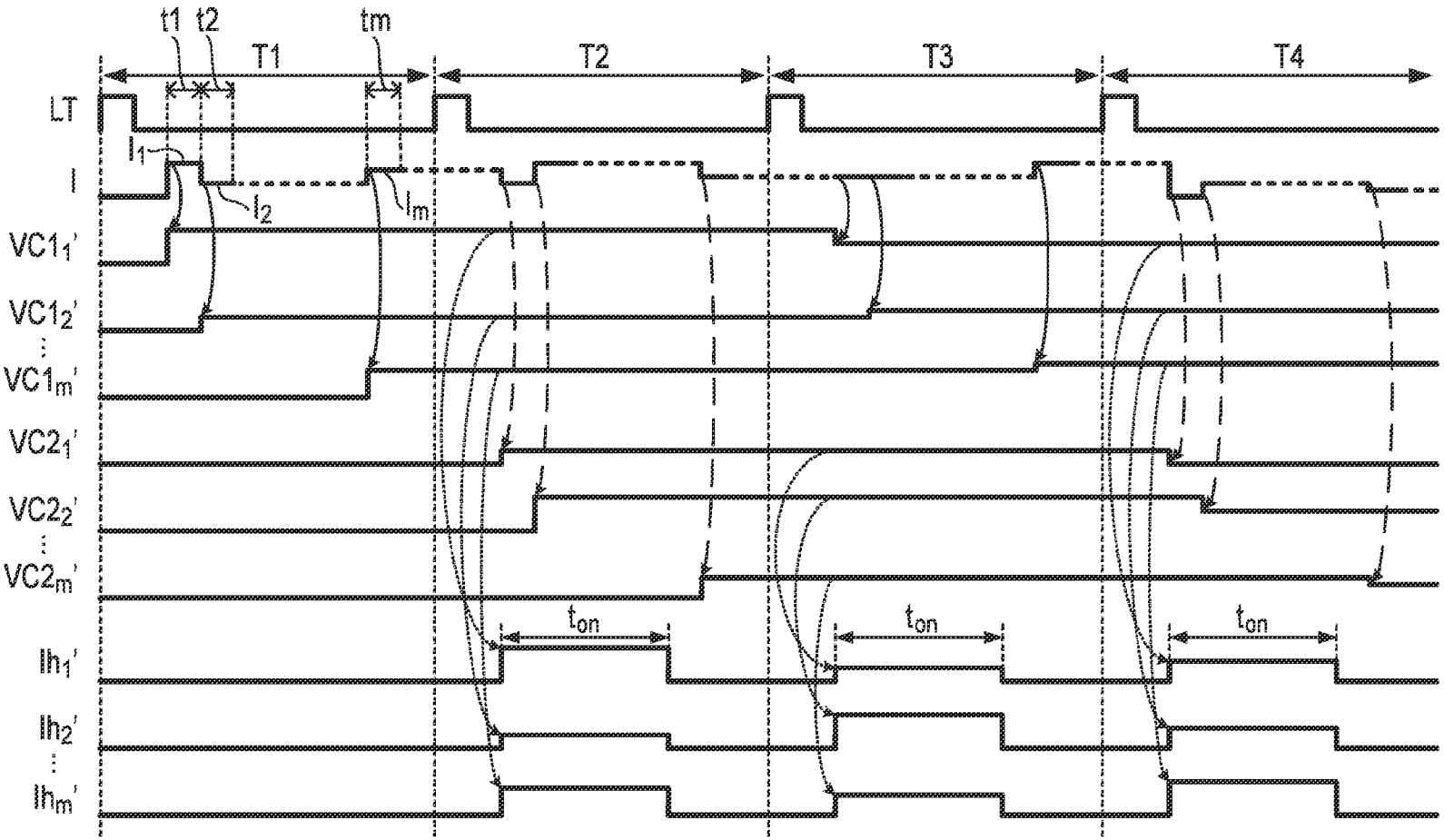
FIG. 9 is a timing chart for explaining an example of a printhead substrate operation method according to the third embodiment.

FIG. 9 is a timing chart for operating the substrate 101. The ordinate represents from the top the latch signal LT, the current I of the node N, the output potentials VC1', that is, VC$\mathbf{1}_1$' to VC$\mathbf{1}_m$' of first differential amplifiers 51, and the output potentials VC2', that is, VC$\mathbf{2}_1$' to VC$\mathbf{2}_m$' of second differential amplifiers 52. Further, current amounts Ih, that is, $Ih_1$ to $Ih_m$ flowing through printing elements H to be driven in respective groups G are represented below. The abscissa represents the time, and represents the first cycle T1, second cycle T2, third cycle T3, and fourth cycle T4.

In the first cycle T1, the first operation described in the first embodiment is performed sequentially in modules $E_1$ to $E_m$ by using the first voltage holding units 41 out of the first voltage holding units 41 and second voltage holding units 42. More specifically, the setting units 102 change the switches SW1$c$ to the conductive state, and hold voltages $VC_1$ corresponding to pieces of control information (current information) in the corresponding first voltage holding units $\mathbf{41}_1$ to $\mathbf{41}_m$. After that, the switches SW1$c$ change to the non-conductive state.

In the second cycle T2, the second operation is performed in the modules $E_1$ to $E_m$ by using the first voltage holding units 41 out of the first voltage holding units 41 and second voltage holding units 42. More specifically, the switches Sw1$g$ of the setting units 102 change to the conductive state, and the gates of the MOS transistors Mna receive the voltages $VC_1$'. The voltages $VC_1$' are obtained by amplifying, by the first differential amplifiers 51, the voltages $VC_1$ held by the capacitors C1 of the first voltage holding units $\mathbf{41}_1$ to $\mathbf{41}_m$. The second current sources 20 supply currents of amounts corresponding to the pieces of control information (current information) input in the first cycle T1. In response to this, the third current sources 30 supply currents of amounts corresponding to the pieces of control information to the printing elements H of the corresponding groups G, similar to the second embodiment. Thereafter, the switches Sw1$g$ change to the non-conductive state. The printing elements H of the respective groups G used in the second cycle T2 are the printing elements $H_1$ of the first block. The driving elements $D_1$ are activated in the period $t_{on}$ in order to drive the printing elements $H_1$.

In the second cycle T2, at the same time as the second operation using the first voltage holding units 41, the first operation is performed in the modules $E_1$ to $E_m$ by using the second voltage holding units 42 out of the first voltage holding units 41 and second voltage holding units 42. More specifically, the setting units 102 change the switches SW2$c$ to the conductive state, and hold voltages $VC_2$ corresponding to pieces of control information in the corresponding second voltage holding units $\mathbf{42}_1$ to $\mathbf{42}_m$. Then, the switches SW2$c$ change to the non-conductive state.

In the third cycle T3, the second operation is performed in the modules $E_1$ to $E_m$ by using the second voltage holding units 42 out of the first voltage holding units 41 and second voltage holding units 42. The printing elements H of the respective groups G used in the third cycle T3 are the printing elements $H_2$ of the second block. The driving elements $D_2$ are activated in the period $t_{on}$ in order to drive the printing elements $H_2$. At the same time, in the third cycle T3, the first operation is performed in the modules $E_1$ to $E_m$ by using the first voltage holding units 41 out of the first voltage holding units 41 and second voltage holding units 42.

In the fourth cycle T4, the second operation is performed in the modules $E_1$ to $E_m$ by using the second voltage holding units 42 out of the first voltage holding units 41 and second voltage holding units 42. The printing elements H of the respective groups G used in the fourth cycle T4 are the printing elements $H_3$ of the third block. The driving elements $D_3$ are activated in the period $t_{on}$ in order to drive the printing elements $H_3$. At the same time, in the fourth cycle T4, the first operation is performed sequentially in the modules $E_1$ to $E_m$ by using the first voltage holding units 41 out of the first voltage holding units 41 and second voltage holding units 42. Subsequently, the first voltage holding units 41 and second voltage holding units 42 alternately repeat the first and second operations in the above-described way. By performing the above operation, currents corresponding to pieces of control information (current information) are supplied to all the printing elements H including the printing elements $H_1$ of the first block up to the printing elements $H_n$ of the nth block in the respective groups G.

In this fashion, the first voltage holding units 41 and second voltage holding unit 42 in the setting units 102 on the substrate 101 can parallelly perform different operations out of the first and second operations. By alternately repeating the first and second operations by the first voltage holding units 41 and second voltage holding units 42, printing coping with characteristic variations between printing elements can be performed continuously. Also, currents coping with characteristic variations between printing elements can be set within a short time.

According to the third embodiment, printing coping with characteristic variations between printing elements on the single printhead substrate can be performed, and a higher-quality image can be printed more quickly.

The three embodiments have been described. However, the present invention is not limited to them, the purpose, state, application, function, and other specifications can be appropriately changed, and the present invention can also be practiced by another embodiment. For example, as a modification of the first embodiment, the setting unit 102 may include the first voltage holding unit 41 and second voltage holding unit 42, similar to the setting unit 102 in the third embodiment. The above-described embodiments have described an arrangement for time-divisionally driving a plurality of printing elements, but the present invention is not limited to this arrangement. As another driving method, the present invention is applicable to an arrangement for setting a current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-139157, filed Jun. 20, 2012, which is hereby incorporated by reference herein in its entirety.

What is claimed is:

1. A printhead substrate comprising:

a plurality of printing elements which are assigned to a plurality of groups;

a plurality of driving circuits which are arranged in correspondence with the respective groups and drive the printing elements;

a first current source configured to generate currents of a plurality of current amounts corresponding to the respective groups;

second current sources which are arranged in correspondence with the respective driving circuits and configured to generate currents to be supplied to the printing elements; and setting units configured to generate voltages in accordance with currents generated by the first current source and set currents to be generated by the second current sources based on the voltages, wherein each of the setting units further includes a sample-and-hold circuit configured to sample and hold a voltage generated inside a current mirror circuit including the second current source, wherein each of the setting units further includes a capacitor configured to charge a current flowing through the current mirror circuit, and wherein the sample-and-hold circuit samples and holds a voltage of the capacitor.

2. The substrate according to claim 1, wherein each of the setting units further includes a switch configured to switch the sample-and-hold circuit between sampling and holding.

3. A printhead substrate comprising:

a plurality of printing elements which are assigned to a plurality of groups;

a plurality of driving circuits which are arranged in correspondence with the respective groups and drive the printing elements;

a first current source configured to generate currents of a plurality of current amounts corresponding to the respective groups;

second current sources which are arranged in correspondence with the respective driving circuits and configured to generate currents to be supplied to the printing elements; and setting units configured to generate voltages in accordance with currents generated by the first current source and set currents to be generated by the second current sources based on the voltages, wherein each of the setting units further includes a sample-and-hold circuit configured to sample and hold a voltage generated inside a current mirror circuit including the second current source, wherein the current mirror circuit includes a first transistor serving as the second current and a second transistor, and wherein the sample-and-hold circuit is connected between a control electrode of the first transistor and a control electrode of the second transistor.

4. The substrate according to claim 1, further comprising third current sources which are arranged between the driving circuits and the setting units for the respective groups, wherein a ground potential of the second current source and a ground potential of the third current source are separated from each other.

5. A printhead substrate comprising:

a plurality of printing elements which are assigned to a plurality of groups;

a plurality of driving circuits which are arranged in correspondence with the respective groups and drive the printing elements;

a first current source configured to generate currents of a plurality of current amounts corresponding to the respective groups;

second current sources which are arranged in correspondence with the respective driving circuits and configured to generate currents to be supplied to the printing elements; and setting units configured to generate voltages in accordance with currents generated by the first current source and set currents to be generated by the second current sources based on the voltages, wherein each of the setting units further includes a sample-and-hold circuit configured to sample and hold a voltage generated inside a current mirror circuit including the second current source, and wherein each of the setting units further includes a plurality of sample-and-hold circuits and selectively performs sampling and holding of the plurality of sample-and-hold circuits.

6. A printhead comprising a printhead substrate defined in claim 1.

7. A printing apparatus comprising:

a printhead defined in claim 6; and a transfer unit configured to transfer, to the printhead, current information for controlling a first current source.

8. The apparatus according to claim 7, wherein the current information is defined for each group or each printing element belonging to the group.

* * * * *